United States Patent [19]

Cameron

[11] 4,035,755

[45] July 12, 1977

[54] NON-VENTING EXPULSION FUSE

[75] Inventor: Frank L. Cameron, North Huntingdon, Pa.

[73] Assignee: Westinghouse Electric Corporation, Pittsburgh, Pa.

[21] Appl. No.: 613,836

[22] Filed: Sept. 16, 1975

[51] Int. Cl.[2] ..... H01H 85/38

[52] U.S. Cl. ..... 337/280; 337/282

[58] Field of Search ..... 335/201; 337/158, 161, 337/228, 273, 276, 279, 280, 281, 282

[56] References Cited

U.S. PATENT DOCUMENTS

| | | | |
|---|---|---|---|
| 3,258,568 | 6/1966 | Patterson et al. | 337/280 X |
| 3,719,912 | 3/1973 | Harner | 337/280 |
| 3,723,930 | 3/1973 | Koch | 337/158 |
| 3,898,602 | 8/1975 | Schurter | 337/280 X |

*Primary Examiner*—Harold Broome
*Attorney, Agent, or Firm*—M. J. Moran

[57] ABSTRACT

An expulsion type fuse is taught which has an opening in the bottom thereof from which hot gases may exit during a fusing operation. The hot gases are provided to a condenser which is disposed adjacent the exit of the expulsion fuse. The disposition of the condenser relative to the fuse is such that none of the gas escapes to any region outside of the expulsion fuse other than the condenser. The condenser has a central axial opening around which is an annularly disposed copper screen. Around the outer periphery of the copper screen is disposed a relatively thin layer of plastic material which may rupture because of pressure or temperature. Around the plastic material is disposed quartz sand. All of the above are disposed within a cylindrical container. When gas exits from the expulsion fuse it is cooled by the copper wire. This causes the precipitation of water from the hot gas. The remaining portion of the gas may attain a relatively high pressure causing the thin plastic material to rupture or be thermally broken thus venting the gas into the sand which surrounds the plastic material. The sand absorbs the energy of the gas. The expulsion fuse and condenser may be disposed inside of a submersible container.

16 Claims, 8 Drawing Figures

FIG. 8.
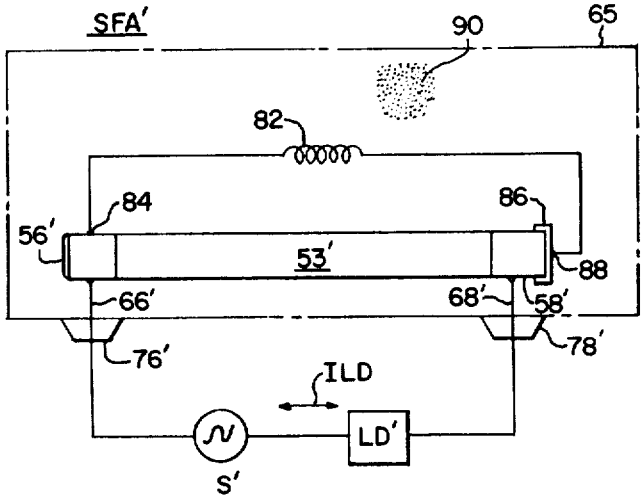
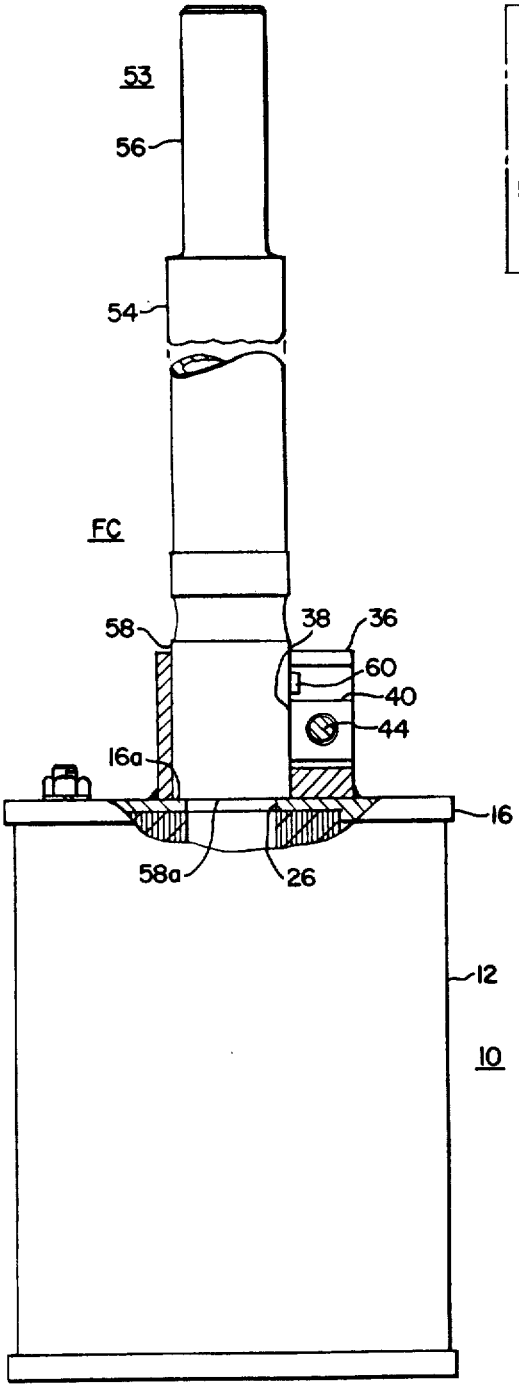
FIG. 3.
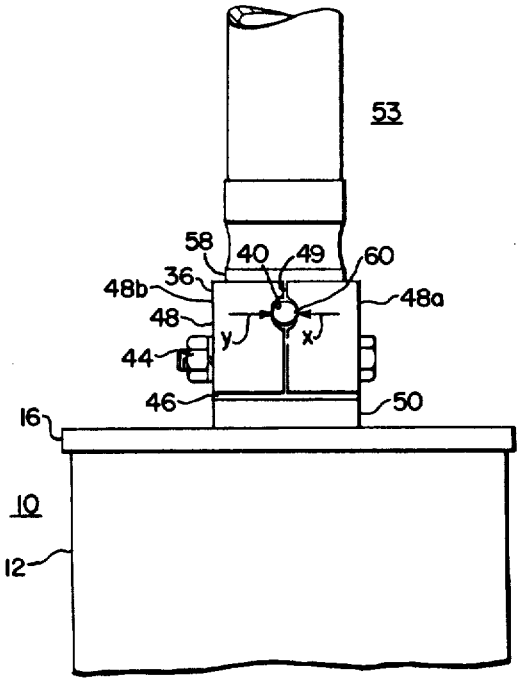
FIG. 4.

NON-VENTING EXPULSION FUSE

BACKGROUND OF THE INVENTION

1. Field of the Invention

The subject matter of this invention is related generally to expulsion type fuses and in particular to expulsion type fuses having condensers associated therewith.

2. Description of the Prior Art

It is known to provide a closed condenser at the end of expulsion type fuse where the condenser has a cooling means therein for cooling and condensing hot gases which may exit the expulsion type fuse. Condensers of this type are described in U.S. Pat. No. 2,077,276, issued to J. Slepian on Apr. 13, 1937 and U.S. Pat. No. 2,184,760, issued to J. M. Wallace on Dec. 26, 1939. Generally the exit gas from the expulsion type fuse is cooled by the cooling means, which may comprise copper tubes or the like disposed in the condenser, thus providing liquid water and a residual gas. In known types of expulsion type fuses, compressed boric acid is utilized in the expulsion type fuse because of certain unique and desirable characteristics. Under the influence of the electric arc the boric acid, which has the chemical formula $H_3BO_3$, decomposes into water ($H_2O$) and boric anhydride ($B_2O_3$). The hot boric anhydride gas has a tendency to produce high pressure within the condenser. Consequently, in any situation where it is desirous that the gaseous products in the condenser do not escape to the outside environment the sealing of the condenser must be carefully completed. Often this is costly, time consuming and in many instances extremely difficult. Furthermore, the hot exit gas from the expulsion type fuse has a tendency to partially destroy a portion of the copper metal screen or a number of the condensing tubes thus introducing small and even microscopic hot or molten particles of electrically conductive material into the boric anhydride gas. Consequently, if the high pressure hot gas leaks out of the condenser, small or microscopic electrically conductive particles may leak with it. Thus, it can be seen that in a situation where it is undesirous for the gases and/or hot particles to excape from the condenser-fuse combination, the prior art condensers present significant problems and disadvantages. One situation where a condenser which leaks gas and/or hot electrically conductive particles is very undesirable is in the submersible expulsion fuse. Other arrangements which are interesting when considering the prior art are disclosed in U.S. Pat. No. 2,647,970, issued to W. S. Edsall et al on Aug. 4, 1953, U.S. Pat. No. 3,368,047, issued to C. McClure, Jr. on Feb. 6, 1968 and U.S. Pat. No. 3,723,930, issued to R. E. Koch on Mar. 27, 1973. An expulsion type fuse which has no condenser is taught in U.S. Pat. No. 3,855,563, issued to F. L. Cameron et al on Dec. 17, 1974.

SUMMARY OF THE INVENTION

In accordance with the invention a non-venting condenser for use with a gas expulsion fuse is taught. The condenser includes a container means which is disposed adjacent to an exhaust port on the gas expulsion fuse. The container means has an opening for receiving expelled gas from the expulsion fuse. This is the kind of gas which would normally be evolved during a fusing operation. There is a condenser disposed inside the container for cooling the gas and condensing water from the gas. There is a rupturable sheath which may be of plastic material such as that sold under the trademark Mylar disposed around the condenser to isolate the condenser from the remaining internal portion of the container. Energy absorbing material such as sand is disposed in this latter region. Consequently, when the gas is introduced into the condenser it is cooled and water vapor is condensed therefrom. However as the gas pressure increases the sheath ruptures and the gas is channeled into the region of the sand where the gas is further cooled, thus reducing the pressure of the gas by removing some of the energy therefrom. Since the gas is cooled and the pressure thereof is reduced the tendency for gas leakage due to the pressurization of the gas is significantly reduced. The container may comprise glass melamine material in the shape of a cylinder. The condenser may comprise copper screen. The condenser may be used as an integral part of an expulsion fuse so that essentially all of the gas which is exited from the expulsion fuse during a fusing operation is condensed in the condenser and thereafter reduced in pressure by interaction with the sand. In another embodiment of the invention the fuse and condenser may be disposed inside of a fluid-proof container thus providing a submersible expulsion type fuse. In still another embodiment an expulsion type fuse without a condenser is taught for utilization in a submersible container of the type previously described. In addition a current limiting fuse element is disposed outside of the expulsion fuse housing but inside of the submersible casing. An external circuit is provided through fluid-tight terminals to the oppositely disposed terminals of the expulsion type fuse and to one end of the previously described current limiting fuse. The other end of the previously described current limiting fuse is fixed or placed close to a plastic or polyethylene cap which is disposed over the exhaust portal of the expulsion type fuse. Consequently, when the expulsion type fuse blows the hot gas ruptures the previously described cap, thus providing a flashover region between the other end of the current limiting fuse and one terminal of the expulsion type fuse. This places the expulsion type fuse and the current limiting element in parallel circuit relationship for a short period of time until the arc drawn within the expulsion type fuse can no longer be sustained therein because of the presence of the current limiting element. After this time current essentially flows through the current limiting element rather than the expulsion type fuse.

BRIEF DESCRIPTION OF THE DRAWINGS

For a better understanding of the invention reference may be had to the preferred embodiments shown in the accompanying drawings in which:

FIG. 3 shows a side elevation partially broken away and partially in section of an expulsion type fuse utilizing the condenser of FIGS. 1 and 2;

FIG. 4 shows a partially broken away section of the fuse and condenser of FIG. 3 as viewed from another angle relative to the axis of the fuse and condenser of FIG. 3;

FIG. 8 shows a combination expulsion type fuse and current limiting fuse in schematic form.

DESCRIPTION OF THE PREFERRED EMBODIMENTS

Figure 1:
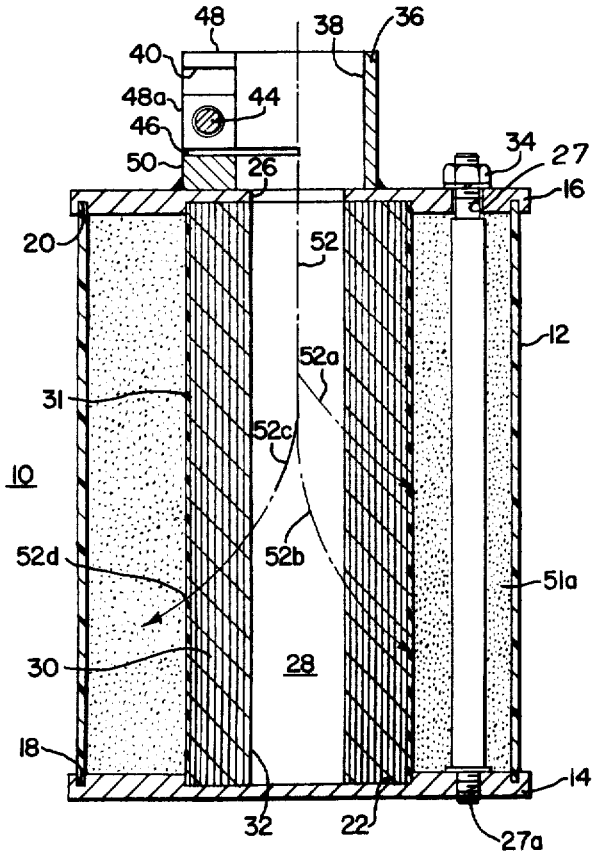
FIG. 1 shows a sectional side elevation of the condenser which is the subject matter of this invention.

Referring now to the drawings and FIG. 1 in particular, a non-venting condenser assembly 10 is shown. The condenser assembly 10 may be utilized with an expulsion type fuse. The condenser assembly 10 may comprise an enclosing tube 12. Enclosing tube 12 may be an elongated electrically insulating or conducting member and in the preferred embodiment of the invention may comprise glass melamine material. In a preferred embodiment of the invention there is also provided a bottom plate 14 and a top plate 16. The bottom plate 14 may comprise an annular groove 18 of the same general diameter as the tube 12 for mating or joining the bottom plate 14 to the tube 12. Similarly the top plate 16 may have a corresponding annular groove 16 for joining the top plate 16 to the cylindrical tube 12. Preferably, the disposition of the tube 12 in terms of structural cooperation with the bottom plate 14 and the top plate 16 at the grooves 18 and 20 respectively is such that the condenser assembly 10 is relatively leak-proof or generally fluid-tight at the region of the interface between the tube 12 and the plates 14 and 16. Bottom plate 14 and top plate 16 may also comprise circular annular recesses 22 and 24. In addition, circular annular recess 24 may have centrally disposed therein an opening 26 for providing a communicating path from a region outside of the condenser to a region inside of the condenser. In addition, top plate 16 may comprise a stud hole 27. In a similar manner bottom plate 14 may comprise an internally threaded opening **27*a* which is aligned generally circumferentially and radially relative to the center line of the condenser assembly 10 with the stud hole or stud opening 27. Disposed internally of the condenser assembly 10 is a condenser core 28. The condenser core 28 may be generally cylindrical in shape and may be disposed securely within the assembly 10 in the annular recesses 22 and 24. The condenser core 28 may in a preferred embodiment of the invention comprise overlapped layers of copper screen 30. The condenser core as thus constructed provides interstices or patterned open regions between the strands of the copper screen material through which hot gas may be passed for efficient condensation of liquids therefrom. In a preferred embodiment of the invention gas which passes through the copper screen has water condensed therefrom by the cooling action of the copper screen. The outer radial surface of the condenser core 28 may have a rupturable sheath 31 disposed therearound for essentially providing a physical barrier between the inside of condenser core 28 and the remaining portion of the condenser assembly 10. It is apparent from viewing FIG. 1 that the portion of the condenser core 28 not occupied by the copper screen 30 comprises an open cylindrical central volume 32. The condenser core 28 and the tube 12 as disposed in the previously described recesses, openings or grooves may be held together in cooperation with top plate 16 and bottom plate 14 by utilizing a stud and nut assembly 34 which extends the axial length of the condenser assembly 10. The stud and nut assembly 34 may have an externally threaded bottom portion which is complementary to the internally threaded opening 27*a* in the bottom plate 14. The stud may therefore be securely affixed to the bottom plate 14 by the cooperation of the corresponding threads on the stud and the threaded opening 27*a*. A nut may be turned on the top externally threaded portion of the stud and nut assembly 34 thus essentially compressing the top plate 16 against the bottom plate 14, consequently holding the component parts of the condenser assembly 10 together in a relatively leak-proof or fluid-tight non-venting configuration. Disposed on the external portion of the top plate 16 of the condenser assembly 10 is a fuse clamp 36. Fuse clamp 36 may comprise a hollow member having a cylindrical central opening 38 which is contiguous with the previously described opening 26 in the top plate 16. A portion of the fuse clamp 36 may have an opening or hole 40 therein, the axis of which is disposed radially to the axis of the fuse clamp 36. Hole or opening 40 is a fuse pin alignment hole which may be utilized to interlock a pin which is securely fixed to a ferrule or other portion of an expulsion fuse (not shown) to the fuse clamp assembly 36 and thusly to the entire condenser assembly 10. Disposed in a plane transverse to the axis of the fuse clamp 36 and radially displaced from the axis of the fuse clamp 36 is a compression bolt and nut assembly 44. A slit or opening 46 which is transverse to the axis of the fuse clamp assembly 36 separates a generally movable or compressible portion 48 of the fuse clamp assembly 36 and a generally fixed portion 50 of the fuse clamp assembly 36. The fixed portion 50 is securely attached to the top plate 16** such as by welding or the like.

Figure 2:
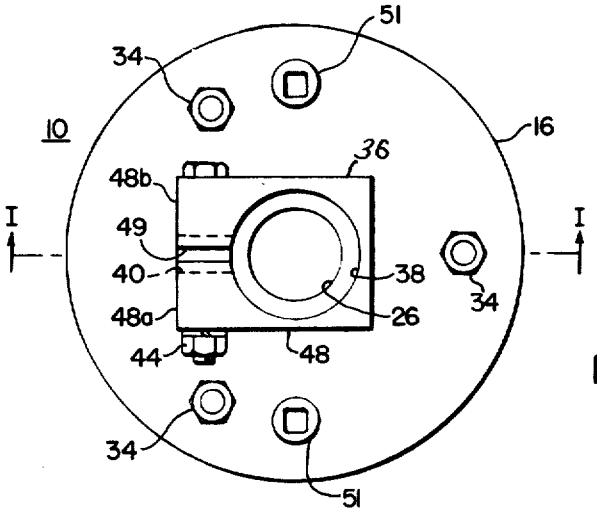
FIG. 2 shows a top view of the condenser of FIG. 1.

Referring now to FIG. 2, the utilization of the compressible portion 48 in conjunction with the compression bolt and nut assembly 44 is clearly shown. The fuse clamp assembly 36 is shown generally disposed centrally of the circular top plate 16 of the assembly 10. The generally centrally aligned circular opening 38 and the cooperating gas entrance hole 26 are also shown. Three radially disposed ends of similar stud-and-nut assemblies 34 are also shown. The stud and nut assemblies 34 in this embodiment of the invention are spaced circumferentially equidistant from each other around the center line of the assembly 10. It can be seen that the compressible portion 48 comprises two portions **48*a* and 48*b* which are separated by a compression slot 49. In the event that a ferrule of an expulsion type fuse is disposed in the central opening 38 the alignment pin thereof (not shown) can be disposed in the fuse pin alignment hole 40 for preventing angular rotation of the fuse about its longitudinal axis. As the compression nut is turned upon the compression bolt 44 the separated compressible portions 48*a* and 48*b* move towards each other tending to narrow the compression slot 49 and tending to narrow the size of the hole 40, thus reducing the radius of curvature of the central opening 38 which provides circumferential pressure against the ferrule of the fuse. Additionally, this action snugly abuts the inside of the hole 40 against the alignment pin of the ferrule. This cooperation will be further described with respect to FIGS. 3 and 4. Also shown disposed in the top plate 16 are two fill holes and associated plugs 51. It is through the fill holes that sand or other pulverulent energy absorbing material, such as quartz sand or the like, is provided into that portion of the internal chamber of the condenser assembly 10 between the shield 31 and the inner walls of the tube 12, the bottom plate 14 and the top plate 16. The sand is provided for cooling any gas the pressure of which may rupture the shield 31 to thus cause flow thereof into the region of the sand 51***a*. It has been found that sand as such is a low cost energy absorbing media with the capability of absorbing about 2 kilowatt-seconds of energy per gram of sand.

Referring once again to FIG. 1, the operation of the condenser assembly 10 may be described. Hot gas 52, which may be exhausted from a fusing expulsion type fuse is introduced at relatively high velocity into the central chamber 32 by way of the opening 26. The gas then quickly flows radially outwardly such as indicated by the representative flow paths 52*a*, 52*b*, 52*c*. As the gas flows through the interstices between the strands of copper screen or other cooling media, water vapor or the like is condensed out. This has a tendency to reduce the pressure of the gas. However, if the amount of exit gas 52 is sufficiently large, the generally restricted volume within the shield 31 quickly causes the pressure of the gas contained therein to become of sufficient magnitude to rupture the shield 31. This is shown diagrammatically at the region 52*d*. Consequently, the pressurized gas which is of a relatively high temperature quickly flows outwardly into the region of the sand 51*a*. Here the energy of the gas is transferred to the absorbing media or sand 51*a*. This causes the gas to further cool and become reduced in pressure because of the cooling effect and because of the availability of the increased volume provided by the remaining region within the condenser assembly 10 provided by the spaces between the grains of sand or absorbing media 51*a*. Because of this, the pressure of the exhaust gas 52 can be significantly reduced, thus eliminating the need for further venting of the gas to the environment outside of the condenser assembly 10. In essence, therefore, utilizing the concepts of the invention, the volume of the condenser, the kinds, size and shape of the condenser core, the amount and disposition of the energy absorbing media may be varied in accordance with the expected discharge from an expulsion type fuse in terms of contained heat and gas pressure to provide an effective non-venting condenser for any kind of known expulsion fuse.

Referring now to FIG. 3, an expulsion type fuse assembly FC is shown. The expulsion type fuse assembly FC comprises an expulsion type fuse 53 and a cooperating condenser 10. The expulsion type fuse 53 may comprise an insulating barrel 54 having a first conductive terminal 56 and a second conducting terminal 58. The expulsion fuse 53 may be a modified version of the fuse shown and described in U.S. Pat. No. 3,855,563 previously referred to. In this embodiment of the invention the ferrule or terminal 58 is disposed in the central opening 38 of the fuse clamp portion 36 of the condenser assembly 10 such that the end surface 58*a* of the ferrule 58 abuts against a surface 16*a* of the top plate 16 of the condenser assembly 10. Such being the case, exhaust or exit gas from the end portion of the ferrule 58 will pass through the opening 26 of the assembly 10 into the previously described central region 32 of the assembly 10. After the fuse 53 has been adequately and properly positioned relative to the condenser 10, the compression bolt and nut assembly 44 is tightened in such a manner that the alignment pin 60 on the ferrule 58 is compressed between portions of the side wall of the fuse pin alignment hole 40, one part of which is shown in FIG. 3. In addition, the tightening of the compression bolt and nut assembly 44 causes the fuse clamp 36 to exert holding or securing pressure against a significant surface region of the ferrule 58.

Referring now to FIG. 4, another view of the region of the fuse clamp 36 of FIG. 3 is shown. In this case it can be seen that as the compression bolt and nut assembly 44 is tightened, the compression portions 48*a* and 48*b* of the fuse clamp 36 move towards each other in the direction of the arrows *x* and *y* to snugly grasp the pin 60 as was described previously. As this occurs, the compression slot 49 necessarily narrows. The separation slit 46 allows the portions 48*a* and 48*b* to move towards each other even though the fixed portion 50 remains relatively stationary with respect to the remaining portion of the fuse assembly 10.

Figure 5:
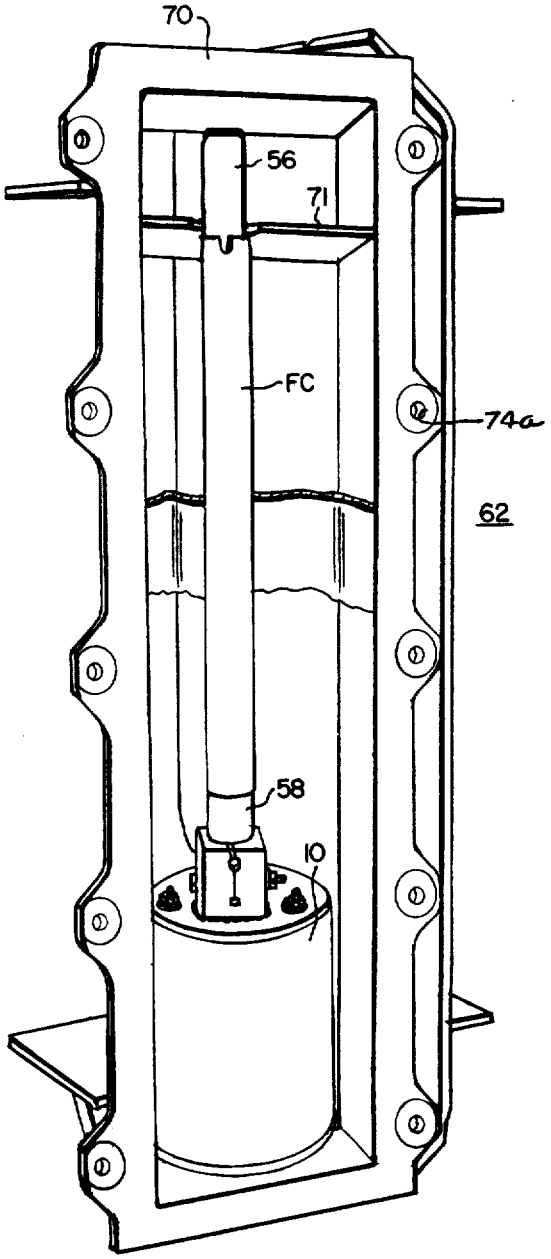
FIG. 5 shows the fuse and condenser of FIGS. 3 and 4 disposed in a portion of a submersible casing.

Referring now to FIG. 5, still another embodiment of the invention is shown in which the fuse assembly FC is disposed in a submersible container. The fuse assembly FC is shown disposed in one separated portion 62 of an enclosable container. There is provided a joining surface 70 which may be utilized in conjunction with a complementary joining surface of another enclosing portion to thus provide a completely sealed and enclosed submersible fuse. Generally, the fuse assembly FC is supported within the enclosure portion 62 by appropriate supporting means such as the support member 71.

Figure 6:
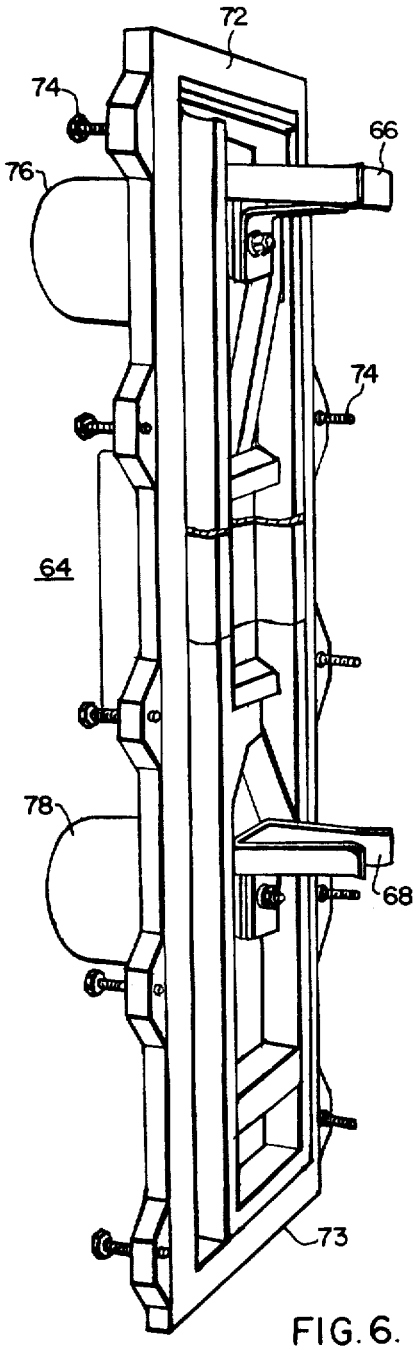
FIG. 6 shows the complementary portion of the submersible casing shown in FIG. 5.

Referring now to FIG. 6, the complementary portion or lid 64 for the closure portion 62 of FIG. 5 is shown. The lid portion 64 has spaced grasping terminal means 66 and 68. The first grasping fuse terminal bracket or terminal means 66 is adapted to grasp the ferrule 56 of the fuse assembly FC. Likewise, the second grasping fuse terminal bracket or terminal means 68 is utilized to grasp the other terminal 58 of the fuse assembly FC. This provides electrical contact between the fuse element of the fuse assembly FC and the terminals 66 and 68. Terminals 66 and 68 are connected to external terminal bushing assemblies 76 and 78 respectively. Consequently, it can be seen that electrical continuity exists from the first bushing 76 to the first bracket 66 to the first ferrule 56 through the main body of the fuse assembly FC to the second ferrule 58 to the second bracket 68 and finally to the second bushing 78. Consequently, an external circuit (shown in FIG. 7) may be interconnected between the first bushing 76 and the second bushing 78 external to the enclosure. It will be noted that the lid portion 64 has a joining surface 72 which is complementary to the joining surface 70 of the enclosure 62 of FIG. 5. When the lid 64 is assembled to the enclosure 62 the surfaces 70 and 72 align and the fuse brackets 66 and 68 align with, engage and grasp the appropriate terminals 56 and 58 respectively of the fuse barrel FC. The enclosure may be further sealed by using a gasket 73 between the surfaces 70 and 72 and be tightening bolts or lug means 74 in threaded holes or openings 74a on the enclosure 62 as shown in FIG. 5.

Figure 7:
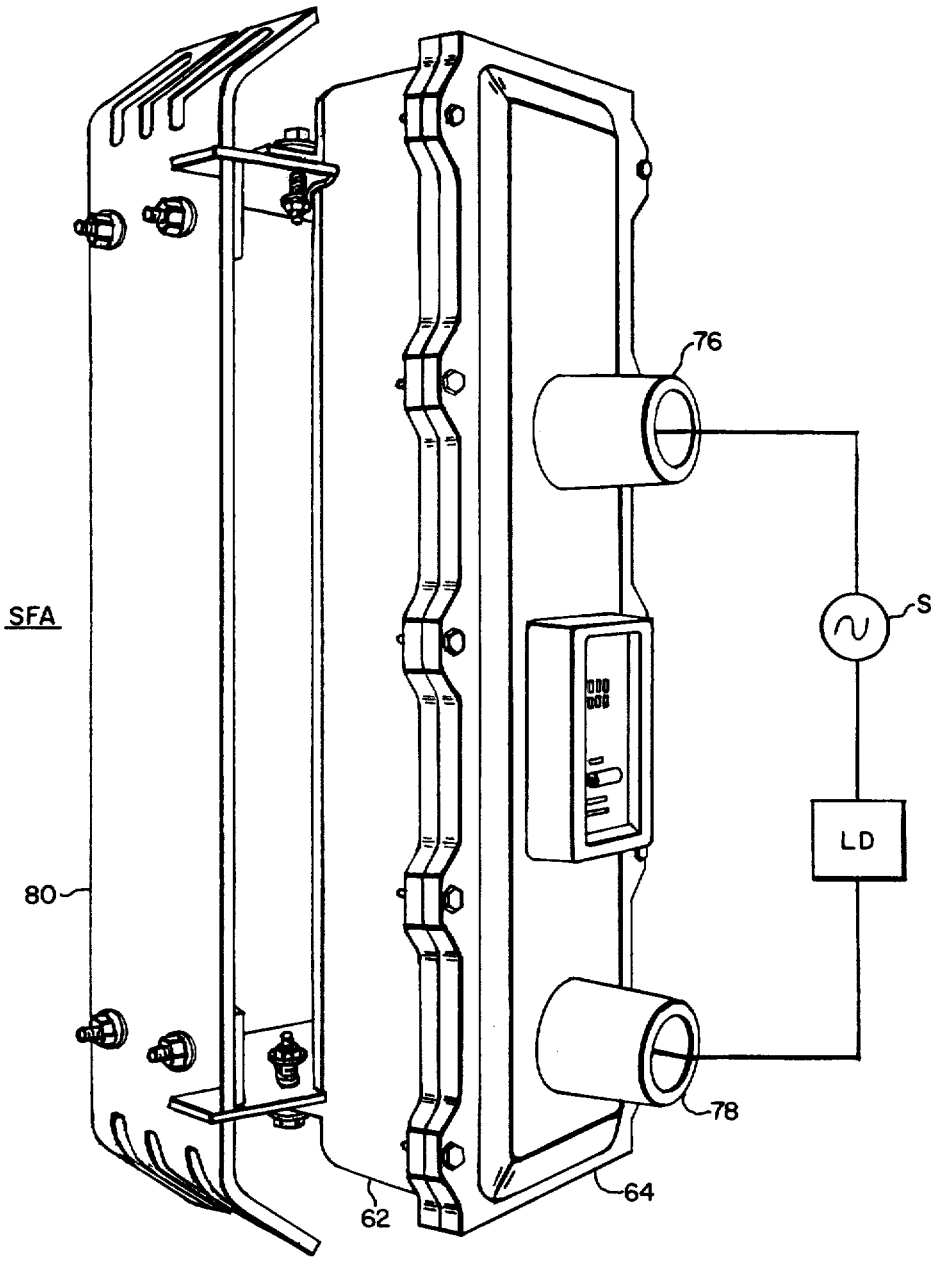
FIG. 7 shows a completely assembled submersible expulsion type fuse.

Referring now to FIG. 7, the submersible, nonventing expulsion fuse SFA is shown in an assembled form. It will be noted that the lid portion 64 is sealably engaged with the enclosure portion 62. A schematic external circuit comprising a source S and a series load LD is shown connected in series circuit relationship with the terminals 76 and 78. A mounting means 80 is shown for disposing the completed fuse assembly SFA on an appropriate supporting means. A fuse assembly SFA which is non-venting and submersible may thus be disposed in underground voltage protection or distribution networks where the presence of liquid water may submerge all or portions of the enclosed fuse assembly SFA.

By referring to FIGS. 5 and 6 it can be seen that because of the presence of the non-venting condenser 10, the fuse assembly can blow or fuse causing gaseous products to be exited from the barrel of the fuse assembly FC into the condenser 10 without allowing these gaseous products to significantly enter into the internal region of the casing of the submersible fuse where they may cause short circuiting between the terminals 66 and 68 for example.

Referring now to FIG. 8, still another embodiment of the invention is shown in which an external source of voltage and current S' and a series connected load LD' are connected in series circuit relationship with the terminals 76' and 78' of a submersible current limiting fuse SFA'. In this embodiment of the invention an expulsion type fuse 53' is connected at the end terminals 56' and 58' thereof to suitable schematically shown fuse brackets 66' and 68' for interconnection with the terminals of the external bushings 76' and 78' respectively. An appropriate sealing means such as a plastic cap 86 is disposed over the exhausting end of the ferrule 58'. A current limiting fuse element 82 is attached at one end thereof in electrical circuit relationship with the ferrule 56' and at the other end thereof in close proximity but not electrical conductivity with the end cap 86 of the ferrule 58'. Both the expulsion fuse element 53' and the current limiting fuse element 82 are disposed within the schematically shown submersible casing 65. In this embodiment of the invention sand or similar other pulverulent arc quenching material 90 which is an energy absorbing media is disposed to essentially fill the container 65. Load current ILD normally circulates through the source S', the load LD' and the expulsion type fuse 53' but not through the current limiting fuse element 82 because there is no electrical circuit connection at point 88 where the fuse element may join the electrically insulating plastic cap or covering means 86. However, if the current IDL increases, due to an overload or fault, to an extent sufficient to cause a fusing operation in the fuse element 53', gas of significantly high pressure will be generated to blow off or rupture the cap 86 thus providing a region of hot gas between the ferrule 58' and the point 88 of the current limiting fuse 82, thus causing flashover or electrical breakdown therebetween, thus introducing the fuse element 82 into electrical circuit relationship with the overload or fault current and the source S'. Generally when this happens, the characteristics of the expulsion type fuse are such that it no longer conducts current. Rather overload or fault current continues to flow in a path including the current limiting fuse element 82. The sand 90 act as a pulverulent arc quenching material and energy absorption material for the current limiting fuse element 82 and yet allows electrical conductivity between the point 88 on the fuse element 82 and the ferrule 58'.

It is to be understood with respect to the various embodiments of the invention that the exact shape and configuration of the condenser assembly 10 is not limiting. As an example it may have a square or rectangular cross section rather than a circular cross section as shown in FIGS. 1 and 2. It is also to be understood that the fuse assembly 10 shown in FIGS. 1 and 2 may comprise a unitary construction, that is the end portions 14 and 16 may be totally or partially unitized with the tube member 12. It is also to be understood that the condenser core 28 is not limited to a wound copper screen. It is also to be understood that the sheath material or shield 31 may comprise a rupturable plastic material such as is known and sold under the trademark Mylar or may comprise other rupturable plastic or similar material including nonplastic material. It is also to be understood that the representative diagrammatic gas flow paths **52*a* through 52*c* are merely provided for purposes of illustration and are not limiting in nature. In fact, it is known that the gas does not necessarily follow discrete paths such as may be indicated but generally continuously expands through the interstices of the condenser core 28 thus applying pressure to the internal part of the shield or sheath 31. It is also to be understood that the expulsion type fuse 53 is not limited to that shown and described with respect to FIGS. 3 and 4** but may be any appropriate expulsion type fuse having appropriate venting means for gaseous products of the fusing operation. It is also to be understood that the configuration, shape and size of the outer casing for the submersible fuse SFA is not limiting.

The apparatus taught in accordance with this invention have many advantages. One advantages lies in the fact that an expulsion type fuse utilizing a non-venting condenser may be disposed inside of a fluid-tight casing so that the entire fuse assembly may be submersible, that is disposed in a position where water partially or entirely surrounds the casing. Situations of the latter kind are often found in underground distribution systems in large cities where the water table occasionally rises in the underground chambers and channels which accommodate the electrical system or where spot or large scale flooding may introduce water into the underground chambers. Another advantage lies in the fact that the fuse and condenser may be utilized in an environment where it is undesirable to have the hot gaseous products of a fusing operation vented into a region where electrical or mechanical damage can be caused thereby or where personnel may be injured. Another advantage lies in the fact that an expulsion fuse having a condenser may be utilized in an explosive environment where the hot gases are not made available to cause an explosion or to ignite other gaseous products therearound. Explosive or ignitable environments of this kind are often found in chemical process plants, gasoline refineries, mines and the like.

What I claim as my invention is:

1. Expulsion fuse apparatus, comprising:

a. gas expulsion fuse means which exits gas from an exhaust port as the result of a fusing operation;

b. container means disposed adjacent said exhaust port of said gas expulsion fuse means, said container means having an opening therein for receiving expelled gas from said expulsion fuse means;

c. condenser means disposed within said container means for receiving said gas and for cooling and condensing said gas;

d. rupturable sheath means disposed around said condenser means for separating said condenser means from the remaining internal portion of said container means, said sheath means being ruptured at a predetermined gas pressure; and e. energy absorbing means disposed in said remaining internal portion of said container means, said expelled gas if not sufficiently cooled by said condenser means rupturing said sheath means and thus escaping into the region of said energy absorbing means, the energy of said gas thus being further absorbed to reduce the pressure of said gas, said remaining internal portion of said container means containing said pressure-reduced gas therein.

2. The combination as claimed in claim 1 wherein said container means comprises a cylindrical tube of glass melamine material.

3. The combination as claimed in claim 1 wherein said condenser means comprises copper material.

4. The combination as claimed in claim 1 wherein said energy absorbing means comprises sand.

5. The combination as claimed in claim 1 wherein said rupturable sheath means comprises a relatively thin sheet of flexible plastic material.

6. The combination as claimed in claim 5 wherein said container means comprises a cylindrical tube of glass melamine material, wherein said condenser means comprises copper mesh in the form of an annular cylinder which is generally concentric in cross section with said cylindrical tube, and wherein said energy absorbing means comprises sand.

7. The combination as claimed in claim 1 wherein said gas expulsion fuse means comprises a non-current limiting fuse element and a current limiting fuse element disposed in side by side relationship with one end of each being electrically interconnected and the other end of each being separated by an insulating gap which flashes over electrically during a fusing operation because of the presence of said gas.

8. Expulsion fuse apparatus, comprising:

a. gas expulsion fuse means which exits gas from an exhaust port as the result of a fusing operation;

b. container means disposed adjacent said exhaust port of said gas expulsion fuse means, said container means having an opening therein for receiving expelled gas from said expulsion fuse means;

c. condenser means disposed within said container means for receiving said gas and for cooling and condensing said gas;

d. sheath means disposed around said condenser means for separating said condenser means from the remaining internal portion of said container means, said sheath means being broken at a predetermined gas temperature; and e. energy absorbing means disposed in said remaining internal portion of said container means, said expelled gas if not sufficiently cooled by said condenser means breaking said sheath means and thus escaping into the region of said energy absorbing means, the energy of said gas thus being further absorbed to reduce the temperature of said gas, said remaining internal portion of said container means containing said temperaturereduced gas therein.

9. The combination as claimed in claim 8 wherein said container means comprises a cylindrical tube of glass melamine material.

10. The combination as claimed in claim 8 wherein said condenser means comprises copper material.

11. The combination as claimed in claim 8 wherein said energy absorbing means comprises sand.

12. The combination as claimed in claim 8 wherein said sheath means comprises a relatively thin sheet of flexible plastic material.

13. The combination as claimed in claim 12 wherein said container means comprises a cylindrical tube of glass melamine material, wherein said condenser means comprises copper mesh in the form of an annular cylinder which is generally concentric in cross section with said cylindrical tube, and wherein said energy absorbing means comprises sand.

14. The combination as claimed in claim 8 wherein said gas expulsion fuse means comprises a non-current limiting fuse element and a current limiting fuse element disposed in side by side relationship with one end of each being electrically interconnected and the other end of each being separated by an insulating gap which flashes over electrically during a fusing operation because of the presence of said gas.

15. Expulsion fuse apparatus, comprising:

a. gas expulsion fuse means which exits gas from an exhaust port as the result of a fusing operation;

b. container means disposable adjacent said exhaust port of said gas expulsion fuse means, said container means having an opening therein for receiving expelled gas from said expulsion fuse means;

c. condenser means disposed within said container means for receiving said gas and for cooling and condensing said gas;

d. rupturable sheath means disposed around said condenser means for separating said condenser means from the remaining internal portion of said container means, said sheath means being ruptured at a predetermined gas pressure; and e. energy absorbing means disposed in said remaining internal portion of said container means, said expelled gas if not sufficiently cooled by said condenser means rupturing said sheath means and thus escaping into the region of said energy absorbing means, the energy of said gas thus being further absorbed to reduce the temperature of said gas, said remaining internal portion of said container means containing said temperature-reduced gas therein.

16. Expulsion fuse apparatus, comprising:

a. gas expulsion fuse means which exits gas from an exhaust port as the result of a fusing operation;

b. container means disposed adjacent said exhaust port of said gas expulsion fuse means, said container means having an opening therein for receiving expelled gas from said expulsion fuse means;

c. condenser means disposed within said container means for receiving said gas and for cooling and condensing said gas;

d. sheath means disposed around said condenser means for separating said condenser means from the remaining internal portion of said container means, said sheath means being broken at a predetermined gas temperature; and e. energy absorbing means disposed in said remaining internal portion of said container means, said expelled gas if not sufficiently cooled by said condenser means breaking said sheath means and thus escaping into the region of said energy absorbing means, the energy of said gas thus being further absorbed to reduce the pressure of said gas, said remaining internal portion of said container means containing said pressure-reduced gas therein.

* * * * *